US011026012B1

(12) United States Patent
Ko et al.

(10) Patent No.: US 11,026,012 B1
(45) Date of Patent: Jun. 1, 2021

(54) EARPHONE INCLUDING TUNING MEANS

(71) Applicant: ALMUS Corp., Chungcheongnam-do (KR)

(72) Inventors: Ju Heon Ko, Hwaseong-si (KR); Byung Il Min, Suwon-si (KR); Jeong Kwon Park, Yeoju-si (KR); Yeong Jae Lee, Yongin-si (KR)

(73) Assignee: ALMUS CORP., Chungcheongnam-Do (KR)

( * ) Notice: Subject to any disclaimer, the term of this patent is extended or adjusted under 35 U.S.C. 154(b) by 0 days.

(21) Appl. No.: 16/793,158

(22) Filed: Feb. 18, 2020

(51) Int. Cl.
*H04R 1/10* (2006.01)
*H04R 9/06* (2006.01)
*H04R 1/28* (2006.01)

(52) U.S. Cl.
CPC ..... *H04R 1/1075* (2013.01); *H04R 1/2826* (2013.01); *H04R 9/06* (2013.01)

(58) Field of Classification Search
CPC ..... H04R 1/02; H04R 1/10; H04R 1/1016; H04R 1/1041; H04R 1/1058; H04R 1/1075; H04R 1/008; H04R 9/02; H04R 9/04; H04R 9/06; H04R 9/027; H04R 9/045; H04R 9/046; H04R 25/604; H04R 2499/11; H04R 2231/003; H04R 2460/11
See application file for complete search history.

(56) References Cited

U.S. PATENT DOCUMENTS

2009/0279729 A1* 11/2009 Huang ..... H04R 1/24 381/345
2009/0291718 A1* 11/2009 Fukazawa ..... H04R 1/225 455/575.1
2012/0020501 A1* 1/2012 Lee ..... H04R 1/1091 381/151
2013/0195293 A1* 8/2013 Ko ..... H04R 1/24 381/191
2014/0119556 A1* 5/2014 Tanaka ..... H04R 9/06 381/74
2014/0348372 A1* 11/2014 Seo ..... H04R 1/1016 381/380
2015/0110329 A1* 4/2015 Tanaka ..... H04R 1/1016 381/380
2017/0164088 A1* 6/2017 Fukuda ..... H04R 1/1016
2018/0332378 A1* 11/2018 Guo ..... H04R 1/1008
2019/0037319 A1* 1/2019 Ishii ..... H04R 1/24
2020/0213785 A1* 7/2020 Matsuo ..... H04R 9/027

FOREIGN PATENT DOCUMENTS

KR 20170098527 A 8/2017

* cited by examiner

*Primary Examiner* — Thang V Tran
(74) *Attorney, Agent, or Firm* — Li & Cai Intellectual Property (USA) Office

(57) ABSTRACT

An earphone includes a housing, the speaker unit disposed in the housing, a cover coupled with the housing and including a nozzle, a first space portion disposed in front of the speaker unit, and a second space portion disposed in the rear of the speaker unit and partitioned off from the first space portion. Here, the speaker unit includes a cylindrical yoke with an open top, a magnet fixed to a bottom surface of an inside of the yoke, a plate fixed to a top surface of the magnet, a voice coil disposed between an inner circumference of the yoke and outer circumferences of the magnet and the plate, a vibration plate disposed above the plate and to which the voice coil is fixed, a cap coupled with the yoke, and a frame coupled with the yoke and the cap.

6 Claims, 19 Drawing Sheets

EARPHONE INCLUDING TUNING MEANS

BACKGROUND

1. Field of the Invention

The present invention relates to an earphone.

2. Discussion of Related Art

An earphone includes a speaker unit which generates a sound wave in a housing. Also, the earphone includes a cover including a nozzle with which an ear tip is coupled. The cover is coupled with the housing. Korean Patent Publication No. 10-2017-0098527 (published on Aug. 30, 2017, and hereinafter, referred to as the document) discloses an earphone including a nozzle. In the document, a front housing including the nozzle is coupled with a rear housing including a speaker unit.

Meanwhile, in the document, a tuning hole configured to change a tone may be provided in a cover portion corresponding to the front housing including the nozzle. Some of sound waves generated by the speaker unit are discharged through the tuning hole such that a tone or sound feature of a sound output through the nozzle may be changed. The tuning hole is disposed in a front surface of the cover portion and exposed to the outside. Accordingly, there is a problem that water or foreign substances flow into the housing of the earphone through the tuning hole. Also, there is a problem that external noise causes a loss of sounds of the earphone.

RELATED ART DOCUMENT

[Patent Document]

Korean Patent Publication No. 10-2017-0098527 (published on Aug. 30, 2017)

SUMMARY OF THE INVENTION

The present invention is directed to providing an earphone capable of changing a tone and preventing water or foreign substances from flowing into a housing of the earphone.

The present invention is also providing an earphone capable of fundamentally excluding sound interference from external noise.

Aspects of the present invention are not limited to the above-stated aspects and other unstated aspects of the present invention will be understood by those skilled in the art from a following disclosure.

According to an aspect of the present invention, there is provided an earphone in which a tuning means is provided in a speaker unit. The earphone includes a housing, the speaker unit disposed in the housing, a cover coupled with the housing and including a nozzle, a first space portion disposed in front of the speaker unit, and a second space portion disposed in the rear of the speaker unit and partitioned off from the first space portion. Here, the speaker unit includes a cylindrical yoke with an open top, a magnet fixed to a bottom surface of an inside of the yoke, a plate fixed to a top surface of the magnet, a voice coil disposed between an inner circumference of the yoke and outer circumferences of the magnet and the plate, a vibration plate disposed above the plate and to which the voice coil is fixed, a cap coupled with the yoke, and a frame coupled with the yoke and the cap. Here, the frame includes a tuning hole disposed to pass through from an inner circumferential surface to an outer circumferential surface of the frame, a pipe conduit disposed between the outer circumferential surface of the frame and an inner wall of the housing and configured to communicate with the tuning hole and the second space portion, and a tuning portion which covers the tuning hole.

The frame may include an accommodation groove concavely formed in the outer circumferential surface thereof and a tuning groove located above the accommodation groove and concavely formed. Here, the tuning hole may be disposed in the tuning groove, and the tuning portion may be disposed in the accommodation groove and cover the tuning hole.

The speaker unit may have a cylindrical shape, and the tuning hole may be disposed along a radial direction of the speaker unit.

The tuning portion may include a body, which comes into contact with the accommodation groove, and a tuning material disposed on the body. Here, the tuning material may be disposed to be aligned with the tuning groove and spaced apart from the tuning hole.

A top end of the accommodation groove may be connected to a top surface of the frame, and a bottom end of the accommodation groove may be a stepped surface.

The speaker unit may further include a damper, and the damper may be disposed on a top end of the frame and come into contact with an inner surface of the cover.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 13 is a view illustrating a speaker unit and a tuning portion shown in

FIG. 11;

DETAILED DESCRIPTION OF EXEMPLARY EMBODIMENTS

The aspects, particular advantages, and novel features of the present invention will become apparent from a detailed description of exemplary embodiments with reference to the attached drawings. Also, the terms used in the specification and the claims should not be limited to general or lexical meanings and should be interpreted as meanings and concepts coinciding with the technical concept of the present invention on the basis of a principle in which the inventor can appropriately define the concept of the terms to describe the invention in the best manner. Also, in a description of the present invention, a detailed description of well-known functions or components of the related art will be omitted when it is deemed to obscure the essence of the present invention.

Hereinafter, an earphone according to an embodiment will be described in detail with reference to the attached drawings.

Figure 1:
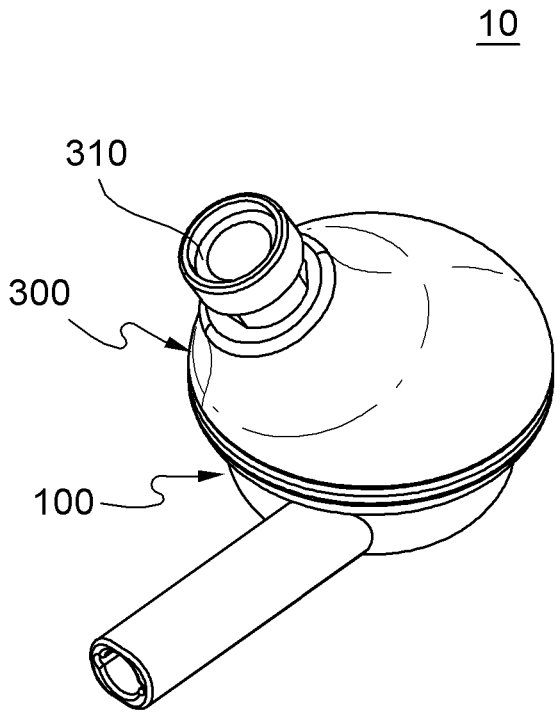
FIG. 1 illustrates an earphone according to a first embodiment.
Figure 2:
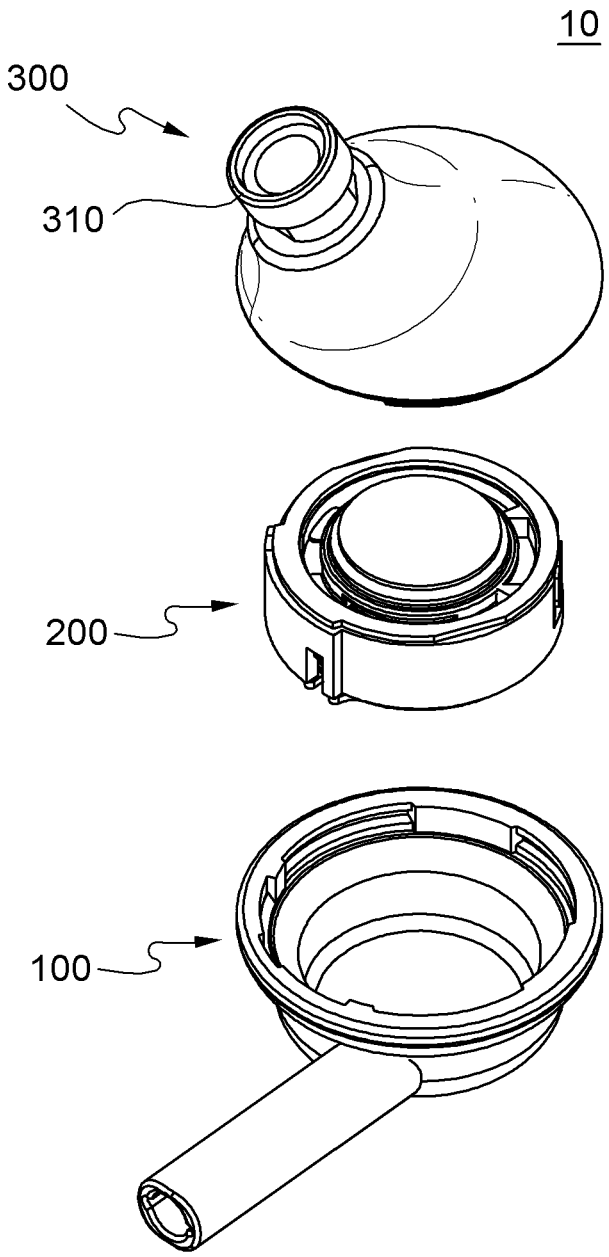
FIG. 2 is an exploded view of the earphone shown in FIG. 1.
Figure 3:
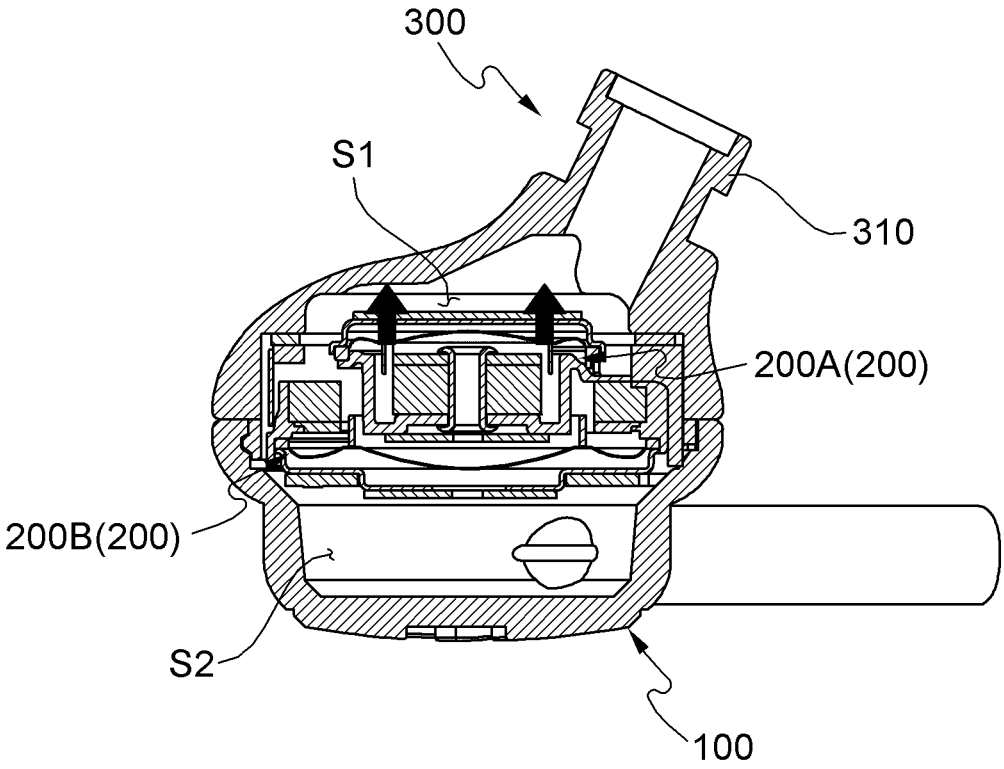
FIG. 3 is a side cross-sectional view of the earphone shown in FIG. 1.

FIG. 1 illustrates an earphone according to a first embodiment, FIG. 2 is an exploded view of the earphone shown in FIG. 1, and FIG. 3 is a side cross-sectional view of the earphone shown in FIG. 1.

Referring to FIGS. 1 to 3, the earphone according to the first embodiment includes a housing 100, a speaker unit 200, and a cover 300. Hereinafter, the terms such as front and front side includes a meaning of indicating a direction of facing the cover 300 on the basis of the speaker unit 200, and the term such as rear indicates a direction of facing the housing 100 on the basis of the speaker unit 200.

The housing 100 accommodates the speaker unit 200 therein. A cable is led into the housing 100. The led cable is connected to the speaker unit 200. Overall, the housing 100 has a cylindrical member with an open front. The cover 300 may be coupled with a front of the housing 100. The front of the housing 100 has an annular shape.

The speaker unit 200 converts an electrical signal into a sound wave which is a voice signal.

The cover 300 is coupled with the housing 100. The cover 300 covers the housing 100 being opened. The cover 300 includes a nozzle 310. The nozzle 310 is a place with which an ear tip is coupled.

While the speaker unit 200 is accommodated in the housing 100 and the cover 300, an inner space of the housing 100 and the cover 300 is divided into a first space portion S1 and a second space portion S2 by the speaker unit 200.

Referring to FIG. 3, the first space portion S1 refers to a space disposed in front of the speaker unit 200. In detail, the first space portion S1 means a space surrounded by inner surfaces of the speaker unit 200 and the cover 300 while the speaker unit 200 is accommodated in the housing 100 and the cover 300. The first space portion S1 communicates with the nozzle 310.

The second space portion S2 means a space disposed in the rear of the speaker unit 200. In detail, the second space portion S2 means a space surrounded by inner surfaces of the speaker unit 200 and the housing 100 while the speaker unit 200 is accommodated in the housing 100 and the cover 100.

The speaker unit 200 of the earphone 10 according to the first embodiment may include a first unit 200A and a second unit 200B. A sound wave generated by the first unit 200A is transmitted to the first space portion S1. A sound wave generated by the second unit 200B is transmitted to the second space portion S2.

Figure 4:
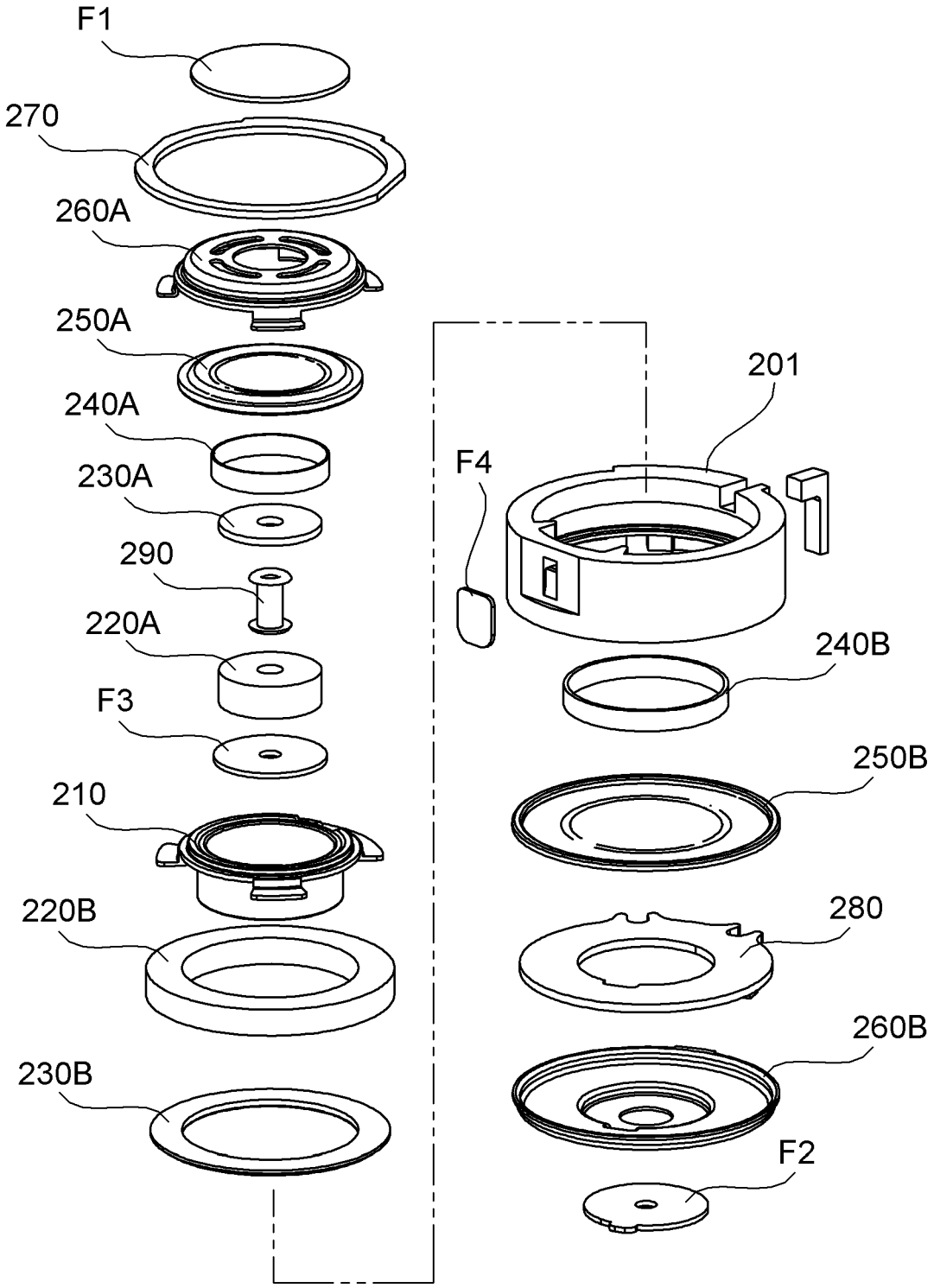
FIG. 4 is an exploded view of a speaker unit shown in FIG. 2.
Figure 5:
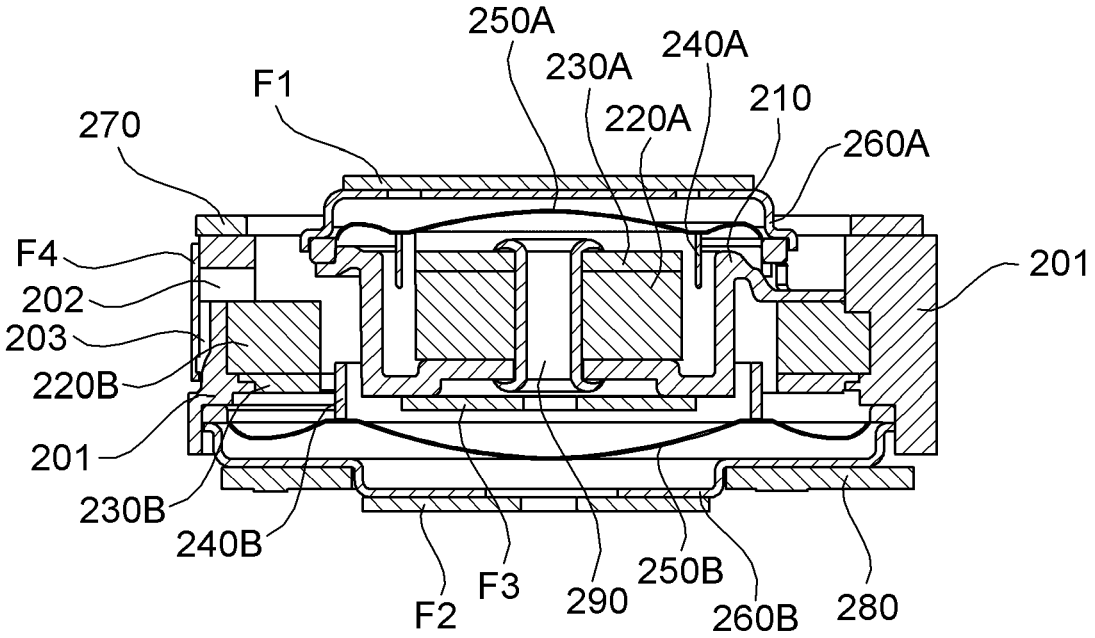
FIG. 5 is a side cross-sectional view of the speaker unit shown in FIG. 2.

FIG. 4 is an exploded view of the speaker unit shown in FIG. 2, and FIG. 5 is a side cross-sectional view of the speaker unit shown in FIG. 2.

Referring to FIGS. 3 to 5, the speaker unit 200 includes a yoke 210.

The yoke 210 is a cylindrical member with an open top. The yoke 210 performs a function of forming a magnetic circuit as well as accommodates magnets 220A and 220B.

The speaker unit 200 includes two magnets 220A and 220B. A first magnet 220A is included as the first unit 200A, and a second magnet 220B is included as the second unit 200B. The first magnet 220A may be accommodated inside the yoke 210, and the second magnet 220B may be accommodated outside the yoke 210. The first magnet 220A may have a cylindrical shape, and the second magnet 220B may have an annular shape. The second magnet 220B may be disposed outside the first magnet 220A.

The speaker unit 200 includes two plates 230A and 230B. A first plate 230A is included as the first unit 200A, and a second plate 230B is included as the second unit 200B. The first plate 230A is disposed on a top surface of the first magnet 220A. The second plate 230B is disposed on a top surface of the second magnet 220B.

The speaker unit 200 includes two voice coils 240A and 240B. A first voice coil 240A is included as the first unit 200A, and a second voice coil 240B is included as the second unit 200B. The first voice coil 240A is fixed to a first vibration plate 250A, and a lower part thereof is disposed between an inner circumference of the yoke 210 and an outer circumference of each of the first magnet 220A and the first plate 230A. The second voice coil 240B is fixed to a second vibration plate 250B, and an upper part thereof is disposed between an outer circumference of the yoke 210 and an inner circumference of each of the second magnet 220B and the second plate 230B.

The speaker unit 200 includes two vibration plates 250A and 250B. The first vibration plate 250A is included as the first unit 200A, and the second vibration plate 250B is included as the second unit 200B. The first vibration plate 250A has an outer circumferential part fixed to an inner parameter of the yoke 210 and is disposed above the first plate 230A. An outer circumferential part of the second vibration plate 250B is fixed to an inner parameter of a second cap 260B and disposed below the second plate 230B.

The speaker unit 200 includes two caps 260A and 260B. A first cap 260A is included as the first unit 200A, and the second cap 260B is included as the second unit 200B. The first cap 260A covers the yoke 210. An inner circumference of a cap 260 may be formed to be greater than the outer circumference of the yoke 210. The second cap 260B covers a bottom of a frame 201. A tuning portion F1 may be disposed on a top surface of the first cap 260A. A tuning portion F2 may be disposed on a bottom surface of the second cap 260B. Also, a tuning portion F3 may be disposed on a bottom surface of the yoke 210.

A damper 270 is disposed on the top surface of the first cap 260A. The damper 270 is disposed along an edge of the first cap 260A and comes into contact with an inner wall of the cover 300.

A substrate 280 is coupled with the bottom surface of the second cap 260B, receives an electrical signal from the outside, and transmits the electrical signal to the first voice coil 240A and the second voice coil 240B.

A rivet 290 passes through and coaxially fastens the yoke 210, the first magnet 220A, and the first plate 230A. A through hole is disposed in a center of each of the yoke 210, the first magnet 220A, the first plate 230A, and the substrate 280, and the rivet 290 passes through the through hole.

The frame 201 is coupled with the yoke 210 and the second cap 260B. The frame 201 surrounds the first unit 200A and the second unit 200B. The frame 201 may be a ring-shaped member including an inner circumferential surface and an outer circumferential surface. The frame 201 includes a tuning hole 202 and a tuning groove 203.

A magnetic field moves to a space between the plates 230A and 230B and the yoke 210. When currents are applied to the voice coils 240A and 240B such that the voice coils 240A and 240B are magnetized, the voice coils 240A and 240B move according to polarities of magnetic forces of the voice coils 240A and 240B. That is, when the polarities of the voice coils 240A and 240B are equal to polarities of the plates 230A and 230B and the yoke 210, the voice coils 240A and 240B are pushed and moved. When the polarities of the voice coils 240A and 240B differ from polarities of the plates 230A and 230B and the yoke 210, the voice coils 240A and 240B are pulled and moved. As described above, when the voice coils 240A and 240B move, the vibration plates 250A and 250B generate sounds by vibrating air while moving back and forth.

Figure 6:
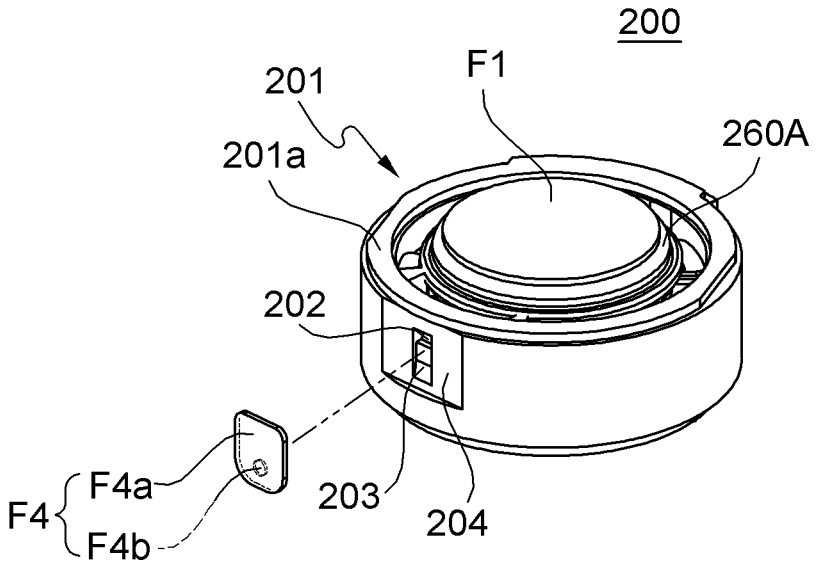
FIG. 6 is a view illustrating the speaker unit including a tuning hole and a tuning portion.
Figure 7:
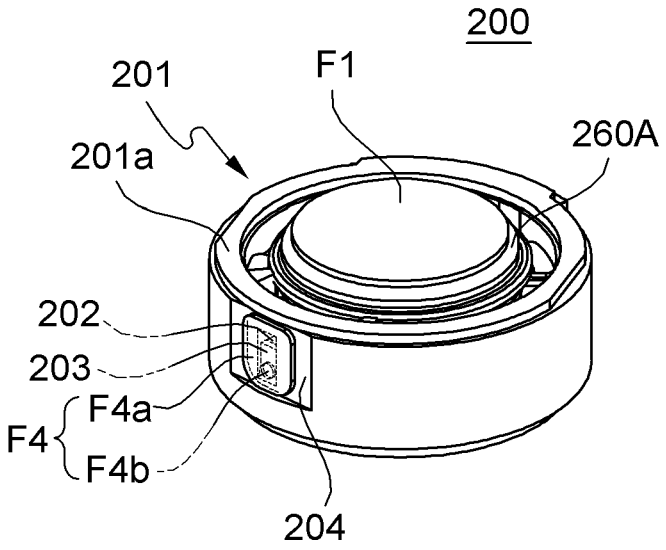
FIG. 7 is a view illustrating the speaker unit with which the tuning portion is coupled.

FIG. 6 is a view illustrating the speaker unit including the tuning hole and the tuning portion, and FIG. 7 is a view illustrating the speaker unit with which the tuning portion is coupled.

Referring to FIGS. 6 and 7, the frame 201 includes an accommodation groove 204 concavely formed in an outer circumferential surface thereof. The accommodation groove 204 has a plane shape formed by partially cutting the outer circumferential surface of the frame 201. A top end of the accommodation groove 204 is connected to a top surface 201*a* of the frame 201. A bottom end of the accommodation groove 204 is a stepped surface. A plurality of such accommodation grooves 204 may be present. The tuning groove 203 is disposed in the accommodation groove 204. Also, the tuning hole 202 is disposed in the tuning groove 203. A plurality of such tuning holes 202 may be present. A tuning portion F4 is mounted in the accommodation groove 204. The tuning portion F4 covers the tuning groove 203 and the tuning hole 202. A shape of the tuning hole 202 may be an oblong shape as shown in the drawing but is not limited thereto and may be a circular shape, an elliptical shape, and the like. Also, a plurality of such tuning holes 202 may be present. The tuning portion F4 may include a body F4*a* and a tuning material F4*b* disposed on the body F4*a*. The body F4*a* comes into contact with the accommodation groove 204. A sound which has passed through the tuning material F4*b* changes in a tone or sound feature. The tuning material F4*b* may be a mesh material and may include polyester, nylon, nonwoven fabric, a membrane filter, and the like.

The tone or sound feature may be minutely adjusted by changing a size and a shape of the tuning hole 202 and a material, density, or the like of the tuning material F4*b*. When a plurality of such speaker units are provided for each size or shape of the tuning hole 202, an advantage of adjusting a tone feature by only replacing the speaker unit is present.

Figure 8:
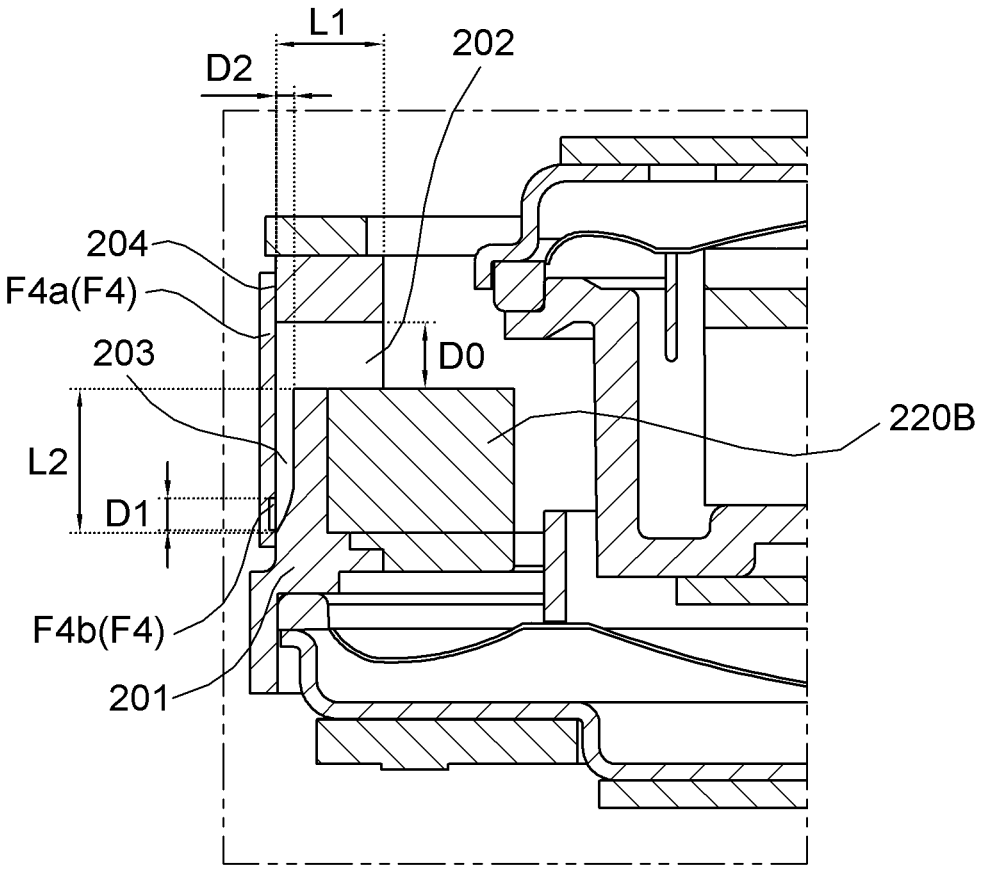
FIG. 8 is a side cross-sectional view of the speaker unit in which a size of the tuning hole and a size of a tuning groove are shown.

FIG. 8 is a side cross-sectional view of the speaker unit in which a size of the tuning hole and a size of the tuning groove are shown.

Referring to FIG. 8, a sound pressure level of a low-frequency range according to a change in a diameter D0 of the tuning hole 202 may be adjusted. Tuning of a sound in a middle-low-frequency range may be performed by adjusting a length L1 of the tuning hole 202, a length L2 of the turning groove 203, and a distance D2 between the tuning portion F4 and the tuning hole 202. Also, the sound feature may be adjusted according to a change in a diameter D1 of the tuning material F4*b*.

Figure 9:
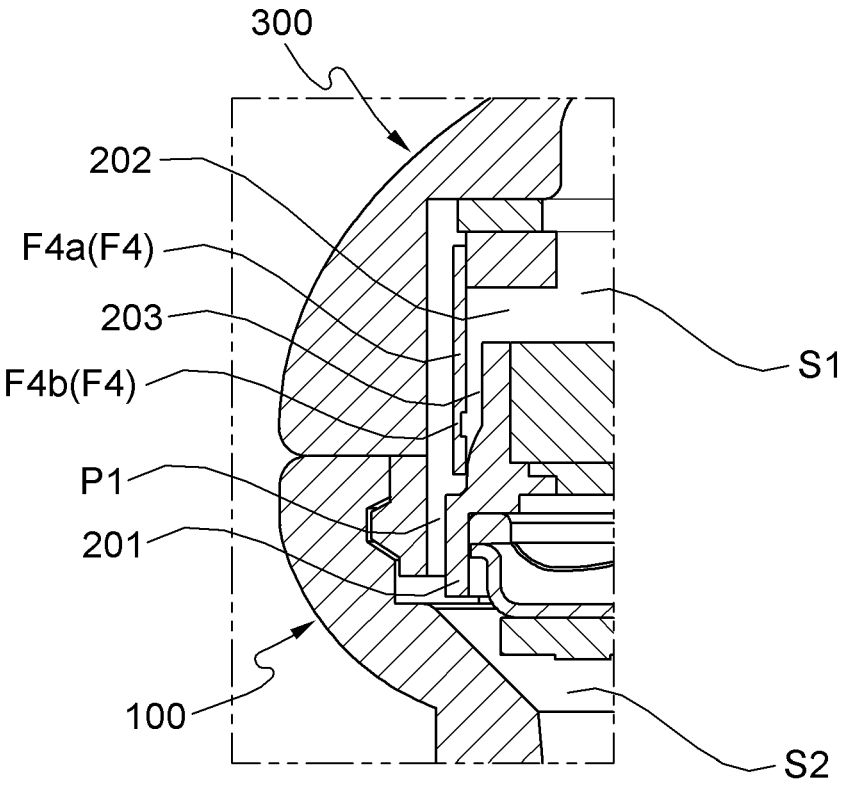
FIG. 9 is a side cross-sectional view of the speaker unit.

FIG. 9 is a side cross-sectional view of the speaker unit.

Referring to FIG. 9, a bottom surface of the tuning groove 203 may include a curved surface from an edge of the tuning groove 203 toward the tuning hole 202. The tuning material F4*b* is disposed to be aligned with the tuning groove 203. Also, the tuning material F4*b* is disposed to be spaced apart from the tuning hole 202. The tuning hole 202 is disposed along a radial direction of the speaker unit 200. The tuning hole 202 is formed to pass through an inner circumferential surface and the outer circumferential surface of the frame 201.

The body F4*a* of the tuning portion F4 and the inner wall of the cover 300 are spaced apart and form a space. A pipe conduit P1 is formed between the outer circumferential surface of the frame 201 and the inner wall of the cover 300. The pipe conduit P1 communicates with the tuning hole 202 via the tuning groove 203. Also, the pipe conduit P1 communicates with the second space portion S2.

Figure 10:
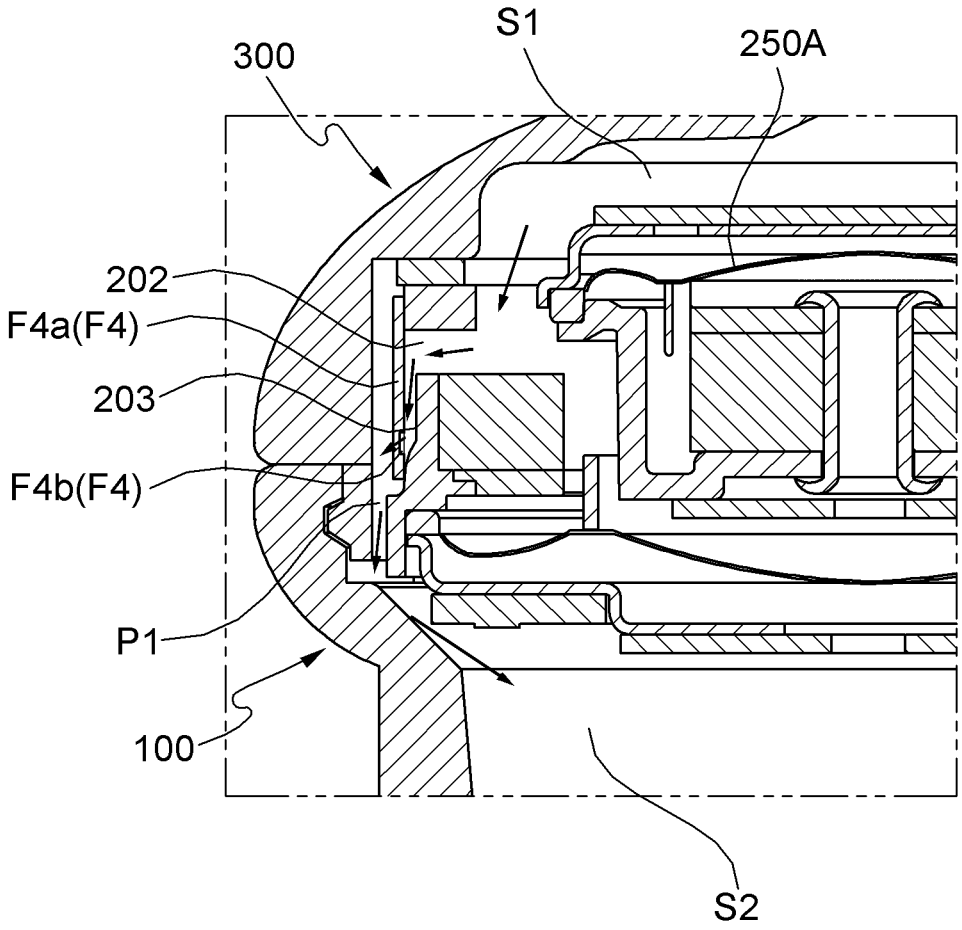
FIG. 10 is a side cross-sectional view of the earphone shown in FIG. 1.

FIG. 10 is a side cross-sectional view of the earphone shown in FIG. 1.

Referring to FIG. 10, a sound generated by moving of the vibration plate 250A is transmitted to the first space portion S1. A part of the sound transmitted to the first space portion S1 passes through the tuning hole 202. During this process, the sound is tuned. The sound, which has passed through the tuning hole 202, passes through the tuning material F4*b* via the tuning groove 203. The sound, which has passed through the tuning material F4*b*, is transmitted to the second space portion S2 through the pipe conduit P1. Here, the cover 300 and the housing 100 exclude a hole communicating with the outside. Accordingly, the space formed by the housing 100 and the cover 300 is in a sealed state such that external noise may be blocked and a loss of the sound may be minimized. Also, since a hole is not present in a surface of the earphone, there is provided an advantage of being strong on an external shock. Also, due to high hermeticity, it is possible to prevent foreign substances or water from flowing into the earphone.

Although the space formed by the housing 100 and the cover 300 is in the sealed state, air in the first space portion S1 is transmitted and communicated to the second space portion S2 through the tuning hole 202. Accordingly, a phenomenon in which fatigue of a tympanum of a listener which may occur due to the sealed space becomes serious or the listener is deafened is prevented.

Figure 11:
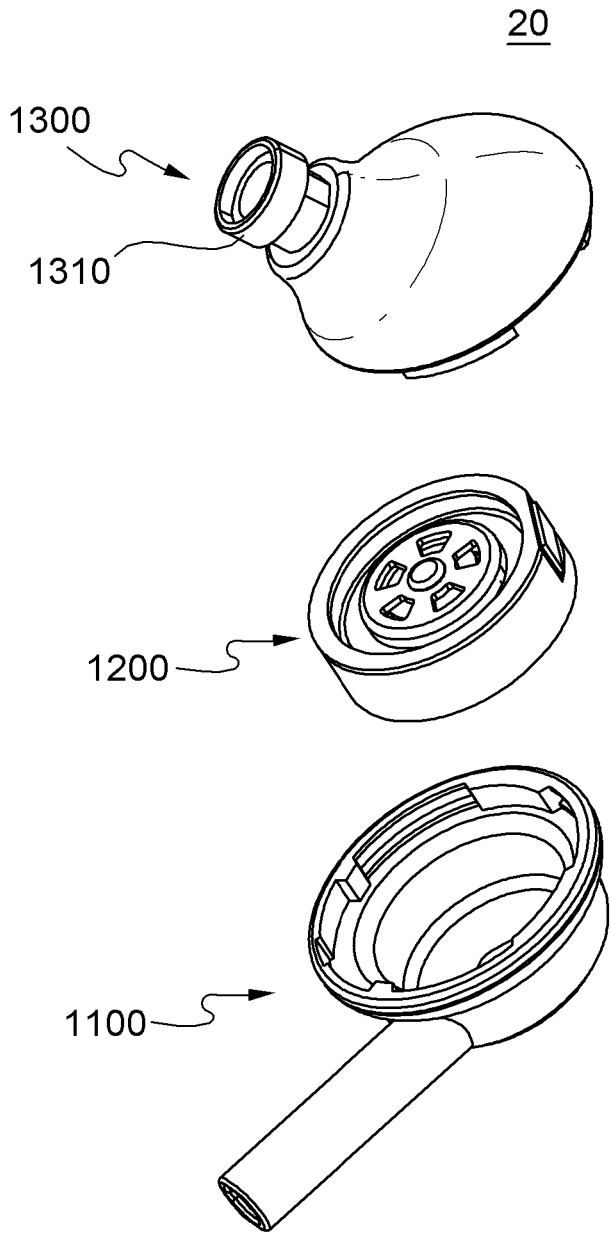
FIG. 11 is an exploded view of an earphone according to a second embodiment.
Figure 12:
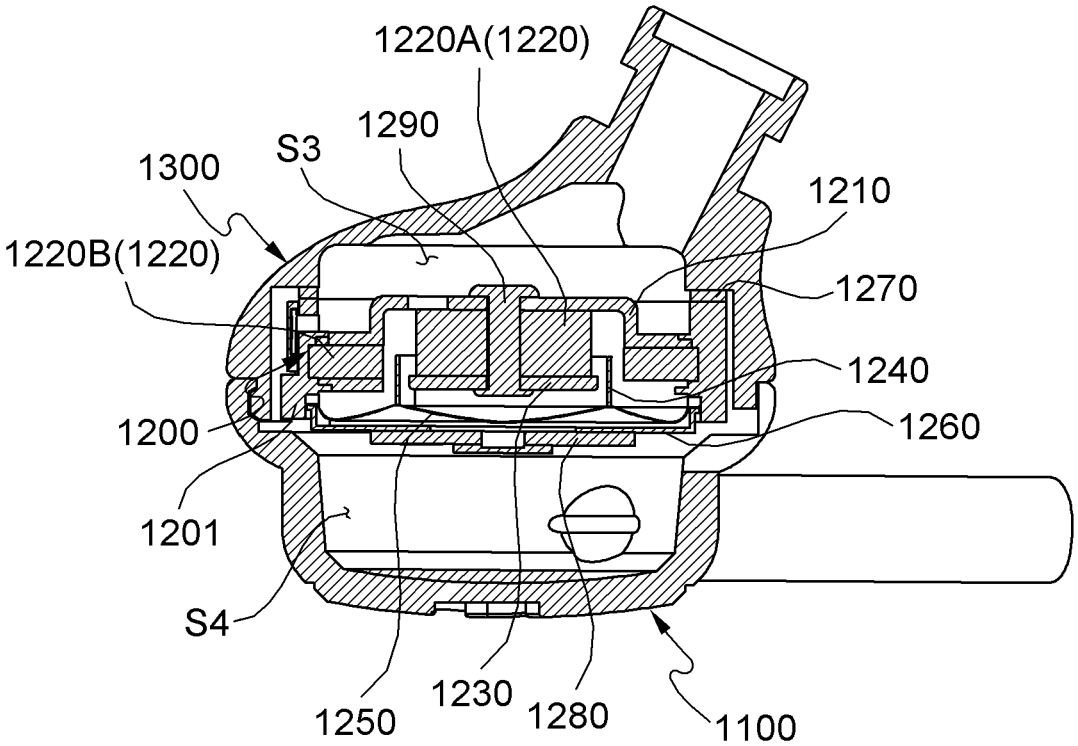
FIG. 12 is a side cross-sectional view of the earphone shown in FIG. 11.

FIG. 11 is an exploded view of an earphone according to a second embodiment, and FIG. 12 is a side cross-sectional view of the earphone shown in FIG. 11.

Referring to FIGS. 11 and 12, an earphone 20 according to the second embodiment includes one speaker unit 1200 unlike the earphone 10 according to the first embodiment.

The speaker unit 1200 includes a yoke 1210, magnets 1220A and 1220B, a plate 1230, a voice coil 1240, a vibration plate 1250, a cap 1260, a damper 1270, a substrate 1280, and a rivet 1290.

The yoke 1210 is adjacent to the first space portion S3. A plurality of holes through which a sound generated by the vibration plate 1250 passes may be arranged in the yoke 1210.

A magnet 1220 may include a third magnet 1220A and a fourth magnet 1220B. The third magnet 1220A and the fourth magnet 1220B are fixed to a bottom surface of an inside of the yoke 1210. The third magnet 1220A may have a cylindrical shape, and the fourth magnet 1220B may have an annular shape. The fourth magnet 1220B may be disposed outside the third magnet 1220A. However, the magnet may include only any one of the third magnet 1220A and the fourth magnet 1220B.

The plate 1230 is fixed to a top surface of the magnet 1220. The plate 1230 is fixed further rearward than the magnet 1220.

The voice coil 1240 is fixed to the vibration plate 1250 such that a part of a lower side is disposed between an inner circumference of the yoke 1210 and outer circumferences of the magnet 1220 and the plate 1230.

The vibration plate 1250 has an outer circumferential part fixed to an inner parameter of the yoke 1210 and is disposed above the plate 1230.

The cap 1260 covers the yoke 1210. An inner circumference of the cap 1260 may be formed to be greater than the outer circumference of the yoke 1210. The cap 1260 is adjacent to a second space portion S4.

The damper 1270 is disposed on the top surface of the cap 1260. The damper 1270 is disposed along an edge of the cap 1260 and comes into contact with an inner wall of the cover 1300.

The substrate 1280 is coupled with a bottom surface of the cap 1260, receives an electrical signal from the outside, and transmits the electrical signal to the voice coil 1240.

The rivet 1290 passes through and coaxially fastens the yoke 1210, the magnet 1220, the plate 1230, and the substrate 1280 to one another.

Figure 13:
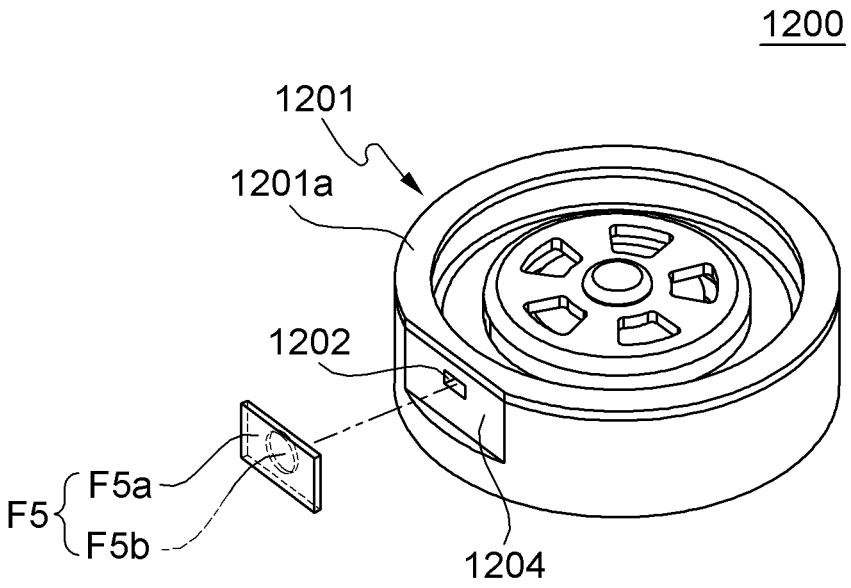

FIG. 13 is a view illustrating the speaker unit and the tuning portion shown in FIG. 11.

Referring to FIG. 13, a frame 1201 includes an accommodation groove 1204 concavely formed in an outer circumferential surface thereof. The accommodation groove 1204 has a plane shape formed by partially cutting the outer circumferential surface of the frame 1201. A top end of the accommodation groove 1204 is connected to a top surface 1201*a* of the frame 1201. A bottom end of the accommodation groove 1204 is a stepped surface. A plurality of such accommodation grooves 1204 may be present. A tuning hole 1202 is disposed in the accommodation groove 1204. A plurality of such tuning holes 1202 may be present. A tuning portion F5 is mounted in the accommodation groove 1204. The tuning portion F5 covers the tuning hole 1202.

A shape of the tuning hole 1202 may be an oblong shape as shown in the drawing but is not limited thereto and may be a circular shape, an elliptical shape, and the like. A plurality of such tuning holes 1202 may be present. The tuning portion F5 may include a body F5*a* and a tuning material F5*b* disposed on the body F5*a*. The body F5*a* comes into contact with the accommodation groove 1204. A sound, which has passed through the tuning material F5*b*, changes in a tone or sound feature. The tuning material F5*b* may be a mesh material and may include polyester, nylon, nonwoven fabric, a membrane filter, and the like.

The tone or sound feature may be minutely adjusted by changing a size and a shape of the tuning hole 1202 and a material, density, or the like of the tuning material F5*b*. When a plurality of such speaker units are provided for each size or shape of the tuning hole 1202, an advantage of adjusting a tone feature by only replacing the speaker unit is present.

Figure 14:
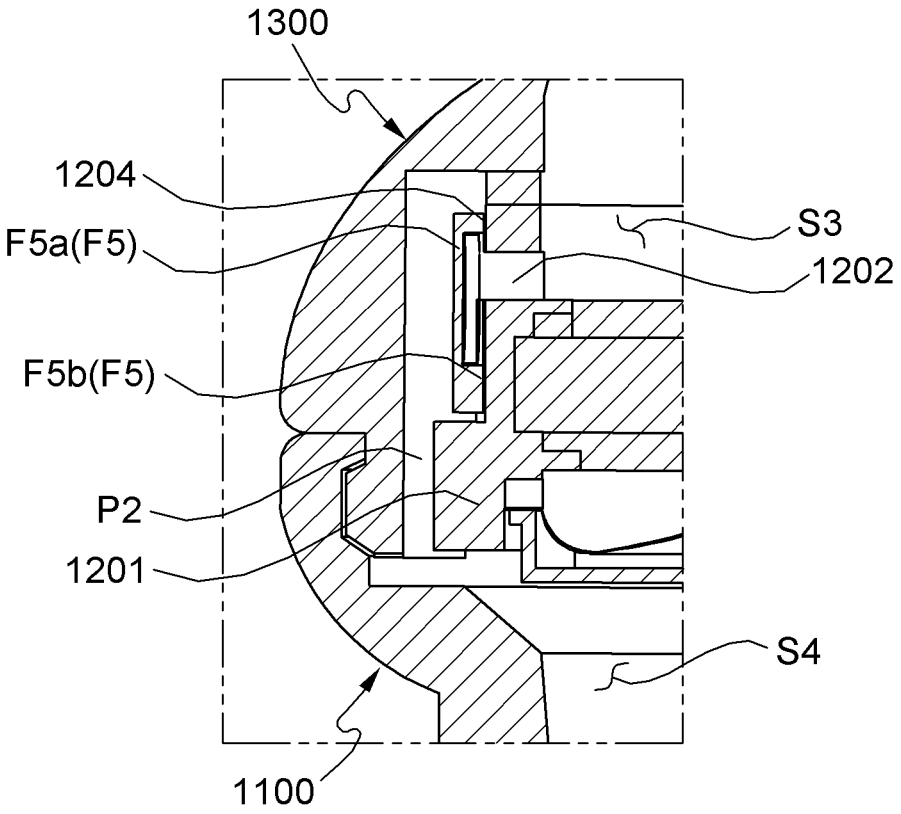
FIG. 14 is a side cross-sectional view of the speaker unit shown in FIG. 11.

FIG. 14 is a side cross-sectional view of the speaker unit shown in FIG. 11.

Referring to FIG. 14, the tuning material F5*b* is aligned with the tuning hole 1202. The tuning hole 1202 is disposed along a radial direction of the speaker unit. The tuning hole 1202 is formed to pass through an inner circumferential surface and the outer circumferential surface of the frame 1201.

The body F5*a* of the tuning portion F5 and an inner wall of the cover 1300 are spaced apart and form a space. A pipe conduit P2 is formed between the outer circumferential surface of the frame 1201 and the inner wall of the cover 1300. The pipe conduit P2 communicates with the tuning hole 1202. Also, the pipe conduit P2 communicates with the second space portion S2.

Figure 15:
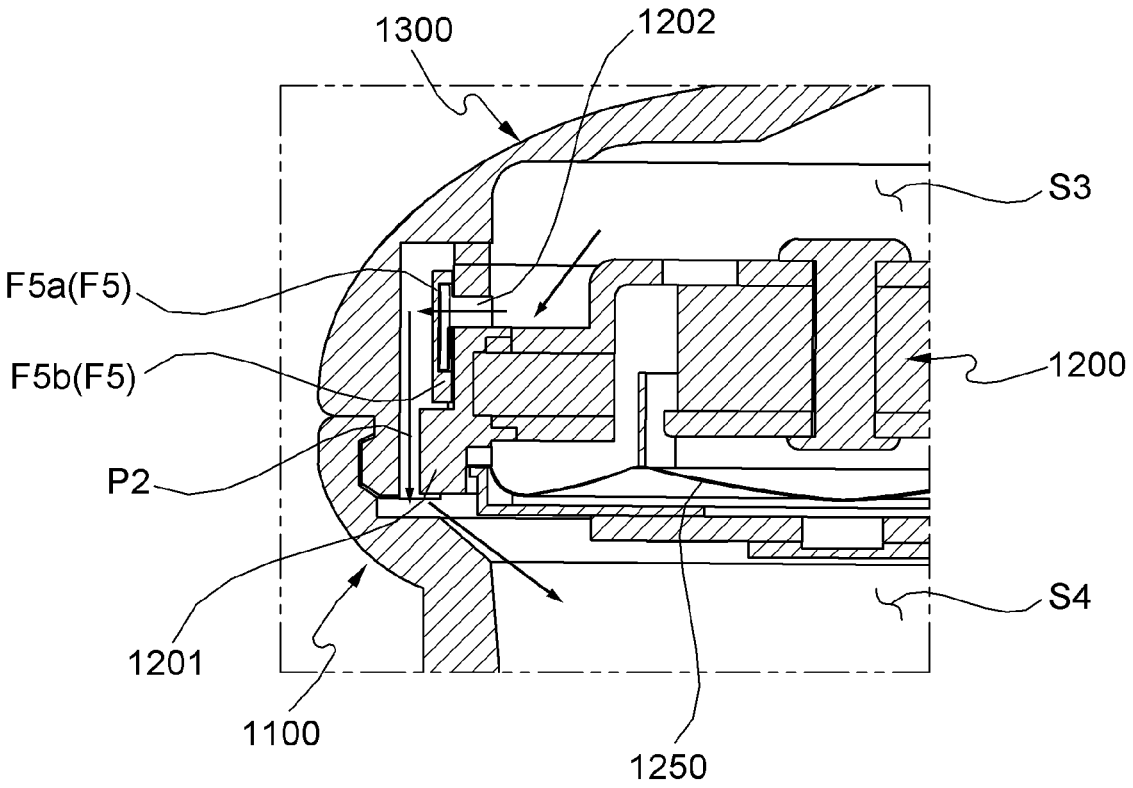
FIG. 15 is a side cross-sectional view of the earphone shown in FIG. 11.

FIG. 15 is a side cross-sectional view of the earphone shown in FIG. 11.

Referring to FIG. 15, a sound generated by moving of the vibration plate 1250 is transmitted to a first space portion S3. A part of the sound transmitted to the first space portion S3 passes through the tuning hole 1202. During this process, the sound is tuned. The sound which has passed through the tuning hole 1202 passes through the tuning material F5*b*. The sound which has passed through the tuning material F5*b* is transmitted to the second space portion S4 through the pipe conduit P2.

Figure 16:
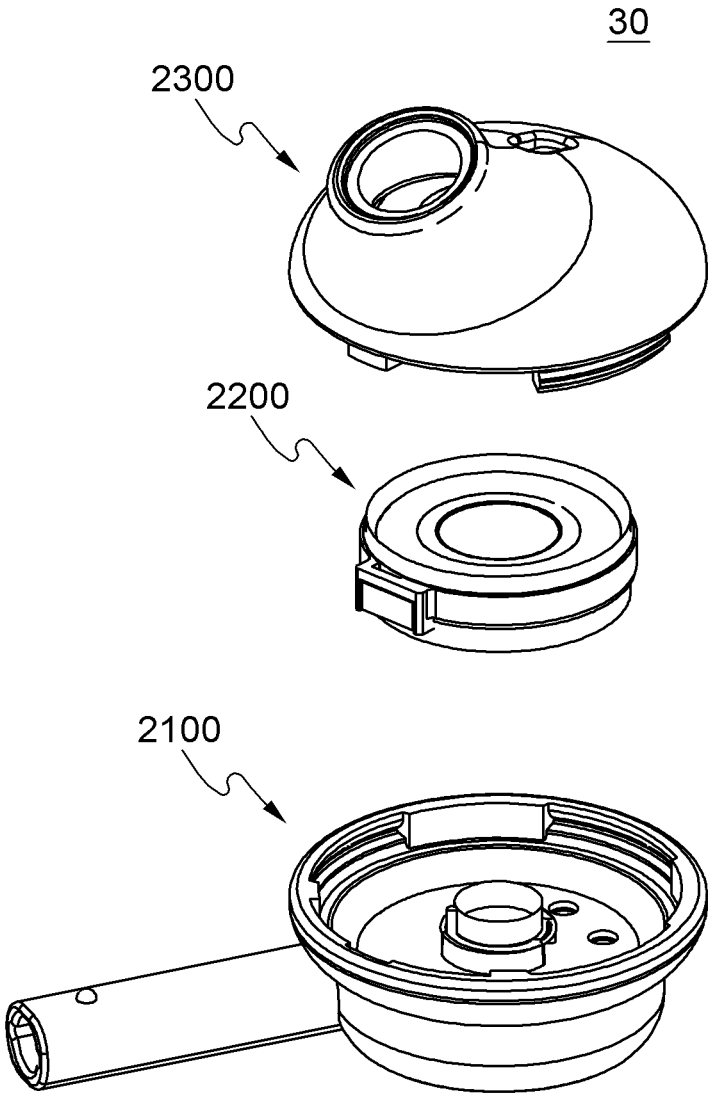
FIG. 16 is an exploded view of an earphone according to a third embodiment.
Figure 17:
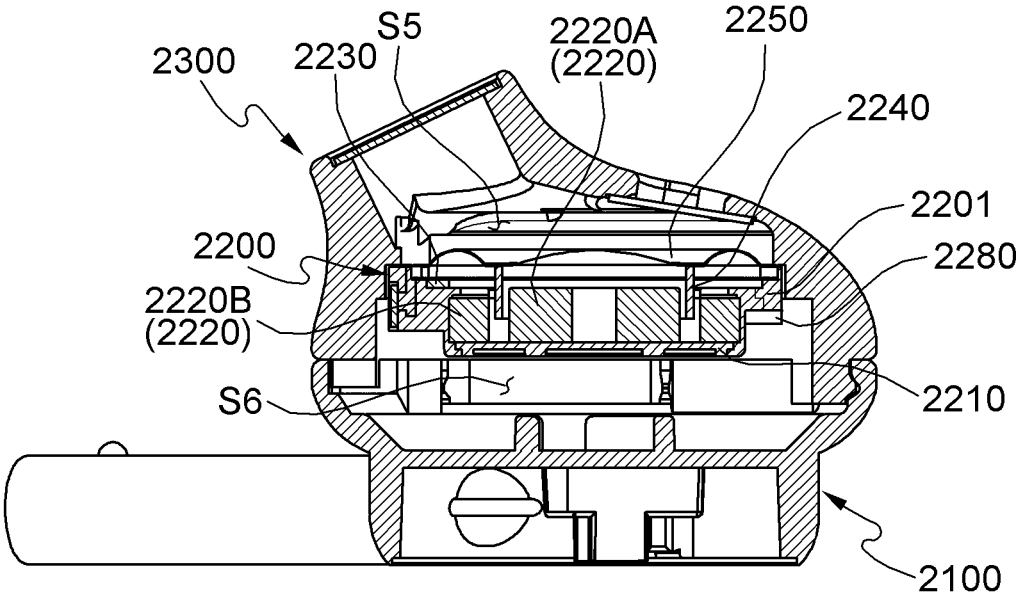
FIG. 17 is a side cross-sectional view of the earphone shown in FIG. 16.
Figure 18:
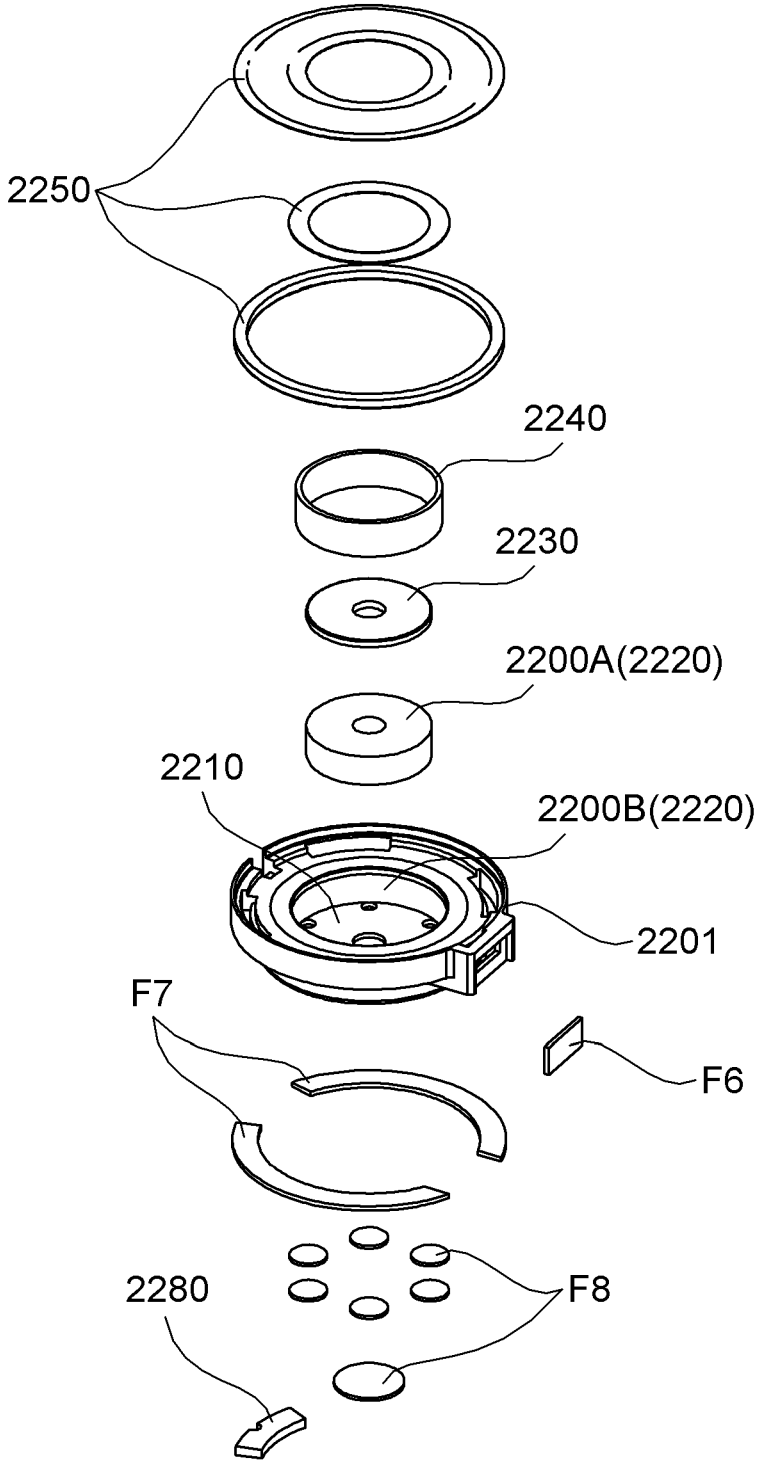
FIG. 18 is an exploded view of a speaker unit shown in FIG. 16.

FIG. 16 is an exploded view of an earphone according to a third embodiment, FIG. 17 is a side cross-sectional view of the earphone shown in FIG. 16, and FIG. 18 is an exploded view of a speaker unit shown in FIG. 16.

Referring to FIGS. 16 to 18, an earphone 30 according to the third embodiment includes one speaker unit 2200 unlike the earphone 10 according to the first embodiment while a vibration plate 2250 is located on a cover 2300.

The speaker unit 2200 may include a frame 2201, a yoke 2210, fifth and sixth magnets 2220A and 2220B, a plate 2230, a voice coil 2240, the vibration plate 2250, and a substrate 2280.

A plurality of holes through which a sound generated by the vibration plate 2250 passes may be arranged in the yoke 2210.

A magnet 2220 may include the fifth magnet 2220A and the sixth magnet 2220B. Each of the fifth magnet 2220A and the sixth magnet 2220B is fixed to the yoke 2210. The fifth magnet 2220A may have a cylindrical shape, and the sixth magnet 2220B may have an annular shape. The sixth magnet 2220B may be disposed outside the fifth magnet 2220A.

The plate 2230 is fixed to one surface of the magnet 2220. The plate 2230 is disposed further forward than the magnet 2220.

The voice coil 2240 is fixed to the vibration plate 2250 such that a part of a lower side is disposed between an outer circumference of the fifth magnet 2220A and an inner circumference of the sixth magnet 2220B.

The vibration plate 2250 has an outer circumferential part fixed to an inner parameter of the frame 2201 and is disposed above the plate 2230.

The substrate 2280 is coupled with a bottom surface of the frame 2201, receives an electrical signal from the outside, and transmits the electrical signal to the voice coil 2240.

A tuning portion F6 may be disposed on a side surface of the frame 2201. A tuning portion F7 having an arc shape may be disposed on the bottom surface of the frame 2201.

A plurality of circular tuning portions F8 may be arranged on the yoke 2210.

Figure 19:
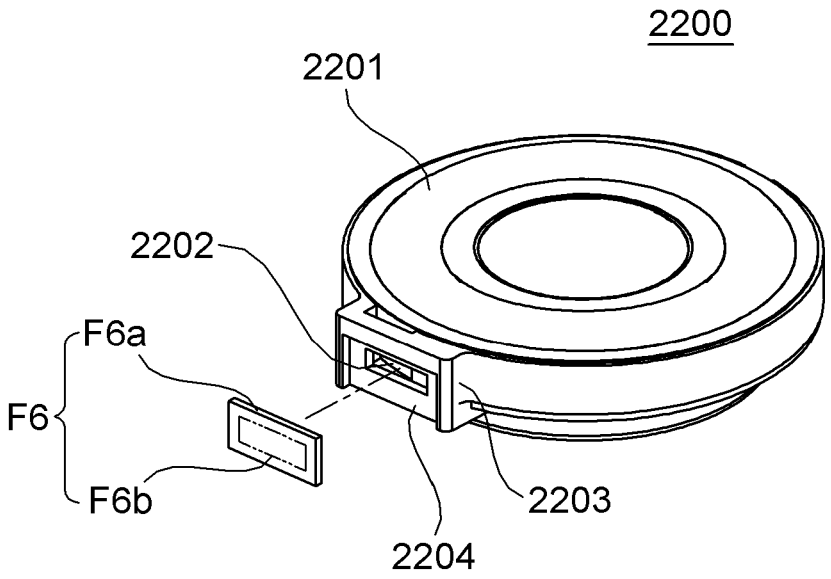
FIG. 19 is a view illustrating the speaker unit and the tuning portion shown in FIG. 18.

FIG. 19 is a view illustrating the speaker unit and the tuning portion shown in FIG. 18.

Referring to FIG. 19, the frame 2201 may include a protruding portion 2203 convexly protruding from an outer circumferential surface thereof. The protruding portion 2203 includes an accommodation groove 2204 which concavely formed. A tuning hole 2202 is disposed in the accommodation groove 2204. The tuning portion F6 is mounted in the accommodation groove 2204. The tuning portion F6 covers the tuning hole 2202.

A shape of the tuning hole 2202 may be an oblong shape as shown in the drawing but is not limited thereto and may be a circular shape, an elliptical shape, and the like. A plurality of such tuning holes 2202 may be present. The tuning portion F6 may include a body F6*a* and a tuning material F6*b* disposed on the body F6*a*. The body F6*a* comes into contact with the accommodation groove 2204. A sound which has passed through the tuning material F6*b* changes in a tone or sound feature. The tuning material F6*b* may be a mesh material and may include polyester, nylon, nonwoven fabric, a membrane filter, and the like.

The tone or sound feature may be minutely adjusted by changing a size and a shape of the tuning hole 2202 and a material, density, or the like of the tuning material F6*b*. When a plurality of such speaker units are provided for each size or shape of the tuning hole 2202, an advantage of adjusting a tone feature by only replacing the speaker unit is present.

Figure 20:
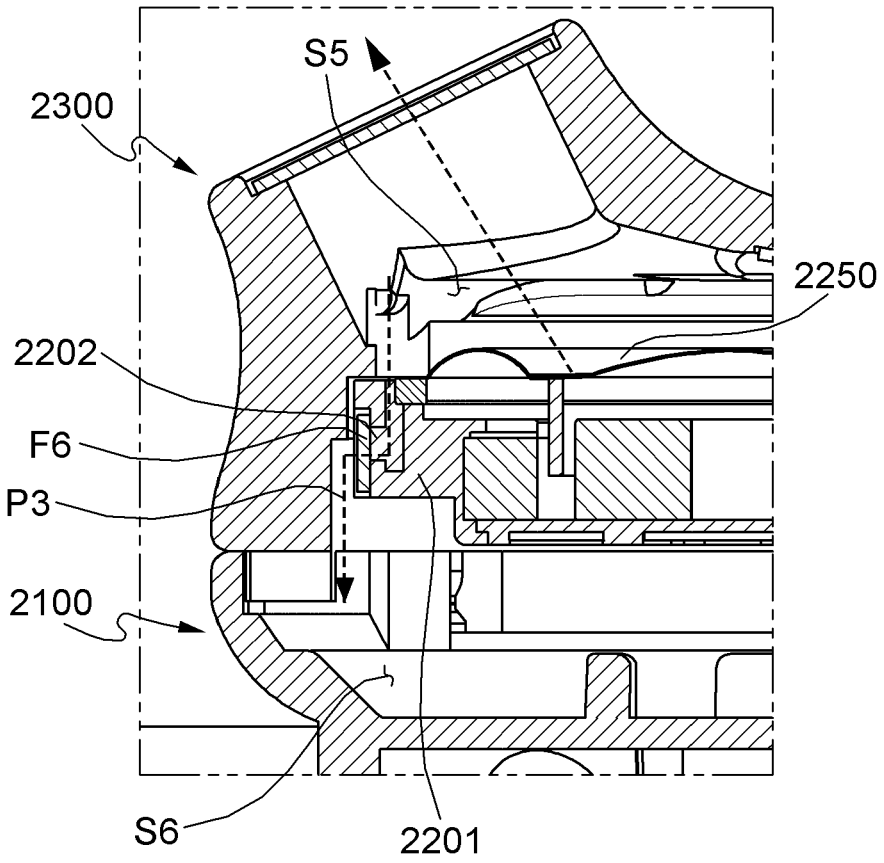
FIG. 20 is a side cross-sectional view of the earphone shown in FIG. 16.

FIG. 20 is a side cross-sectional view of the earphone shown in FIG. 16.

Referring to FIG. 20, the tuning material F6*b* is aligned with the tuning hole 2202. The tuning hole 2202 is disposed along a radial direction of the speaker unit 2200. The tuning hole 2202 is formed to pass through an inner circumferential surface and the outer circumferential surface of the frame 2201.

The body F6*a* of the tuning portion F6 and an inner wall of the cover 2300 are spaced apart and form a space. A pipe conduit P3 is formed between the outer circumferential surface of the frame 2201 and the inner wall of the cover 2300. The pipe conduit P3 communicates with the tuning hole 2202. Also, the pipe conduit P3 communicates with a sixth space portion S6.

A fifth space portion S5 means a space disposed in front of the speaker unit 2200. In detail, the fifth space portion S5 means a space surrounded by inner surfaces of the speaker unit 2200 and the cover 2300 while the speaker unit 2200 is accommodated in a housing 2100 and the cover 2300. The sixth space portion S6 means a space disposed in the rear of the speaker unit 2200. In detail, the sixth space portion S6 means a space surrounded by inner surfaces of the speaker unit 2200 and the housing 2100 while the speaker unit 2200 is accommodated in the housing 2100 and the cover 2300.

A sound generated by moving of the vibration plate 2250 is transmitted to the fifth space portion S5. A part of the sound transmitted to the fifth space portion S5 passes through the tuning hole 2202. During this process, the sound is tuned. The sound which has passed through the tuning hole 2202 passes through the tuning portion F6. The sound which has passed through the tuning portion F6 is transmitted to the sixth space portion S6 through the pipe conduit P3.

According to the embodiment, there is provided an advantageous effect of fundamentally eliminating a tuning hole, which is externally exposed, by forming a tuning hole in a frame of a speaker unit.

According to the embodiment, there is provided an advantageous effect of preventing water or foreign substances from flowing into a housing of an earphone.

According to the embodiment, there is provided an advantageous effect of minutely adjusting a sound by replacing speaker units having different sized through holes.

According to the embodiment, since a hole is not present in a surface of the earphone, there is provided an advantage of being strong on an external shock.

According to the embodiment, there is provided an advantageous effect of preventing a phenomenon in which fatigue of a tympanum of a listener becomes serious or the listener is deafened.

As described above, an earphone in which a tuning means is provided in a speaker unit according to one exemplary embodiment of the present invention has been described in detail.

It should be noted that the above-described one embodiment of the present invention is merely an example in all aspects and is not intended to be limitative, and the scope of the present invention will be defined by the following claims rather than the above detailed description. Also, it should be construed that all changeable or modifiable shapes derived from the meaning and scope of the claims and equivalents thereof are included in the scope of the present invention.

What is claimed is:

1. An earphone, in which a tuning means is provided in a speaker unit, the earphone comprising:

a housing;

the speaker unit disposed in the housing;

a cover coupled with the housing and including a nozzle;

a first space portion disposed in front of the speaker unit; and a second space portion disposed in the rear of the speaker unit and partitioned off from the first space portion, wherein the speaker unit comprises:

a cylindrical yoke with an open top;

a magnet fixed to a bottom surface of an inside of the yoke;

a plate fixed to a top surface of the magnet;

a voice coil disposed between an inner circumference of the yoke and outer circumferences of the magnet and the plate;

a vibration plate disposed above the plate and to which the voice coil is fixed;

a cap coupled with the yoke; and a frame coupled with the yoke and the cap, wherein the frame comprises:

a tuning hole disposed to pass through from an inner circumferential surface to an outer circumferential surface of the frame;

a pipe conduit disposed between the outer circumferential surface of the frame and an inner wall of the housing and configured to communicate with the tuning hole and the second space portion; and a tuning portion which covers the tuning hole.

2. The earphone of claim 1, wherein the frame comprises an accommodation groove concavely formed in the outer circumferential surface thereof and a tuning groove located above the accommodation groove and concavely formed, wherein the tuning hole is disposed in the tuning groove, and wherein the tuning portion is disposed in the accommodation groove and covers the tuning hole.

3. The earphone of claim 1, wherein the speaker unit has a cylindrical shape, and wherein the tuning hole is disposed along a radial direction of the speaker unit.

4. The earphone of claim 2, wherein the tuning portion comprises a body, which comes into contact with the accommodation groove, and a tuning material disposed on the body, and wherein the tuning material is disposed to be aligned with the tuning groove and spaced apart from the tuning hole.

5. The earphone of claim 4, wherein a top end of the accommodation groove is connected to a top surface of the frame, and wherein a bottom end of the accommodation groove is a stepped surface.

6. The earphone of claim 1, wherein the speaker unit further comprises a damper, and wherein the damper is disposed on a top end of the frame and comes into contact with an inner surface of the cover.

* * * * *